United States Patent [19]

Hatvany

[11] Patent Number: 4,566,222

[45] Date of Patent: Jan. 28, 1986

[54] ONE PIECE WINDOW OR DOOR GUARD

[76] Inventor: Charles C. Hatvany, 526 La Tierra Dr., Angwin, Calif. 94508

[21] Appl. No.: 577,595

[22] Filed: Feb. 6, 1984

[51] Int. Cl.[4] ..... E06B 3/68

[52] U.S. Cl. ..... 49/56; 49/57; 49/397

[58] Field of Search ..... 49/50, 56, 57, 463, 49/465, 397

[56] References Cited

U.S. PATENT DOCUMENTS

| | | | |
|---|---|---|---|
| 1,023,625 | 4/1912 | Corey | 49/465 X |
| 3,331,161 | 7/1967 | Ruff | 49/463 X |
| 3,921,334 | 11/1975 | Black, Sr. | 49/56 |
| 4,055,360 | 10/1977 | Russi | 49/56 X |
| 4,057,935 | 11/1977 | Rohrberg et al. | 49/56 |
| 4,070,048 | 1/1978 | Young | 49/56 X |
| 4,258,504 | 3/1981 | Hicks | 49/56 |
| 4,263,747 | 4/1981 | Coltrin et al. | 49/56 |

*Primary Examiner*—Kenneth Downey
*Attorney, Agent, or Firm*—Melvin R. Stidham

[57] ABSTRACT

A window or door guard made of one piece of protective material which conceals hinging and locking components from view and shields them from forcible attack. The guard may be unlocked with a key from the outside, or without a key only from the inside thereof, after which the guard may be easily opened to allow for an emergency escape. The guard may also be removed from its mounting and subsequently remounted, both without a key or tool. No springs, flexible cables, or parts inaccessible to inspection, cleaning, lubrication, or replacement are utilized.

21 Claims, 24 Drawing Figures

ONE PIECE WINDOW OR DOOR GUARD

BACKGROUND OF THE INVENTION

Guards and grilles have been used for centuries to protect windows and doors of buildings from unauthorized entrance, as well as to enhance the appearance of buildings. The practice of placing such guards permanently on buildings had the obvious disadvantage of precluding egress therethrough in an emergency situation, as many municipal ordinances now recognize. Guards which provide a release activated from the inside of a building often had the drawbacks of complicated mechanisms for such release, including springs, flexible cables, and various parts which, once installed, were virtually inaccessible for inspection, cleaning, lubrication, or replacement. The failure or jamming of any of these mechanisms, coupled with an emergency exit situation, could have grievous and fatal results.

In addition, the security aspect of such guards was similarly jeopardized by the open exposure of the hinging and locking components. A guard utilizing even an effective locking device could be defeated by cutting the hinging or locking components. Guards which expose these components to external scrutiny all run the risk of defeat and unauthorized penetration into the protected premises by means as simple as a hacksaw.

A further pejorative aspect of the prior art is that prior guards were not capable of being removed from the wall, as might be desired for cleaning, ease in replacement, or in the case of seasonal usage only, without involved and costly procedures.

Examples of prior art deficient in the ways described (i.e., requiring spring mechanisms and further having exposed hinges and locking devices, etc.) are shown in U.S. Pat. Nos. 3,843,176, 3,921,334, 4,055,360, 4,057,935, 4,070,048, and 4,263,747. None of these inventions, also including those described in U.S. Pat. Nos 4,249,345 and 4,274,228 allow for the removal of the guard without an involved and costly procedure.

SUMMARY OF THE INVENTION

The present invention overcomes the difficulties in the prior art described above by disclosing a guard for a window or door made from one piece of resistive material (steel, etc.) which may have an ornamental pattern cut out for aesthetics, ventillation, light, or a view as desired. This guard is mounted onto hinge bolts, firmly attached to the exterior of a building, by hand and without tools. Remounting is similarly and simply accomplished. The guard is free to pivot on the hinge bolts for a prescribed arc, and when closed, the guard is locked by the simple rotation of a rod-like locking bolt. The hinging and locking components are completely shielded from view, when the guard is closed, by solid rolled edges of the one piece of resistive material. Further protection from forcible attack is afforded by an angle-iron arrangement which protects the side, top, and bottom of the entire hinging and locking mechanisms. The protection by solid masses of resistive material, rather than a mere bar or bolt, securely protects the integrity of this guard from all but the most persistent or lengthy assaults.

This guard may be manufactured cheaply and easily and involves no complicated components requiring extensive preventative maintenance or such that are prone to failure. All parts may be easily inspected, cleaned, lubricated as required, or replaced with a minimum of tools and effort required.

BRIEF DESCRIPTION OF THE DRAWINGS

In the drawings, to which reference will be made in the specification, similar reference numbers have been employed to designate corresponding parts throughout the various views.

FIG. 21 is a front view of all of the components shown in

FIG. 18, mounted on the wall, and including a fragment of the connecting rod.

DETAILED DESCRIPTION OF THE DISCLOSED EMBODIMENT

Figure 1:
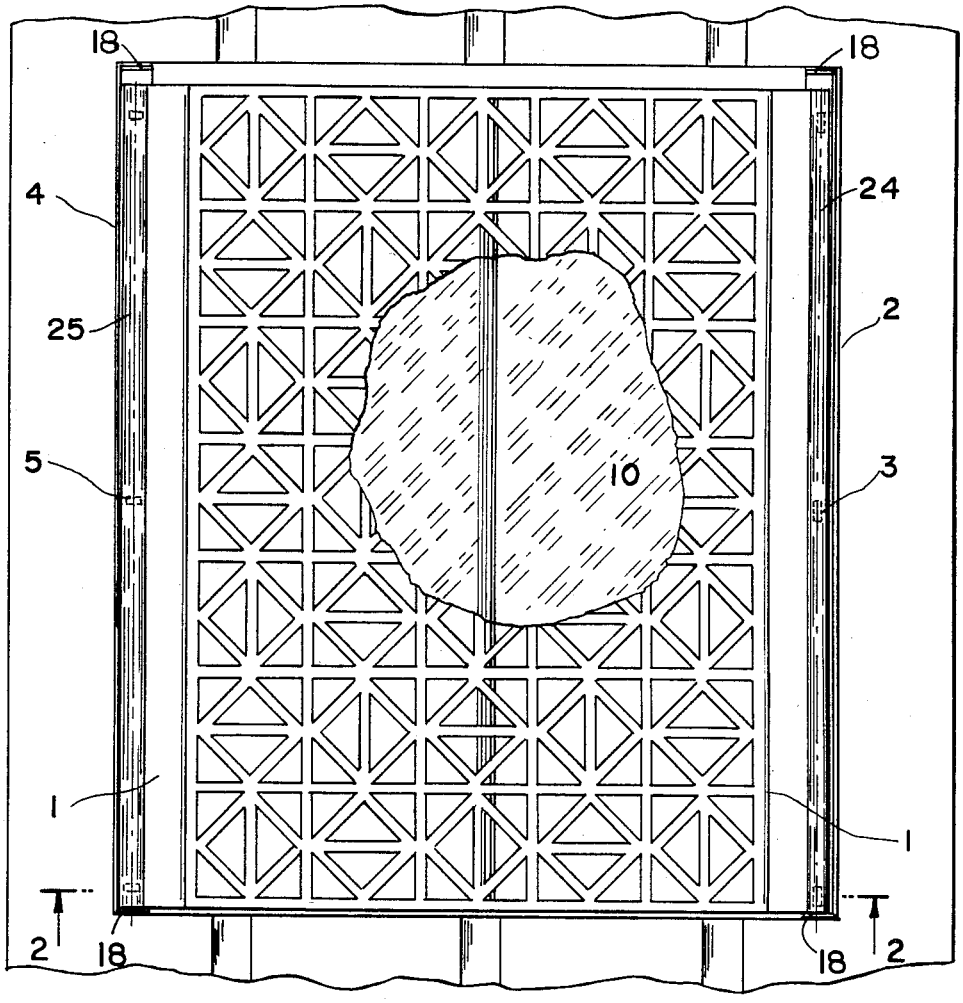
FIG. 1 is a front view of the disclosed embodiment of the present invention, shown installed over a "horizontal-slide aluminum" window.

Referring to FIG. 1, a window guard is shown, covering and protecting the exterior of a window 10 on a building. This window guard is composed of a single sheet guard element 1 of any suitable material, such as steel, reinforced plastic, or laminated components. Various cut outs give this guard a stylish look, and provide light, ventillation, and a view, as desired. Both vertical sides of this window guard are formed by a cylindrical rim 24 and 25. These rims are formed by rolling or folding the flat sheet comprising the guard element 1, or by welding or otherwise attaching an additional member, to result in a reinforced edge. These cylindrical rims 24 and 25 have slits on the "back" sides (i.e., facing the interior and not exposed to the exterior of the building). These slits admit hinge bolts 3 in the cylindrical rim 24 which forms the hinging side, and the locking bolts 5 on the cylindrical rim 25 which forms the locking side.

Figures 2, 3:
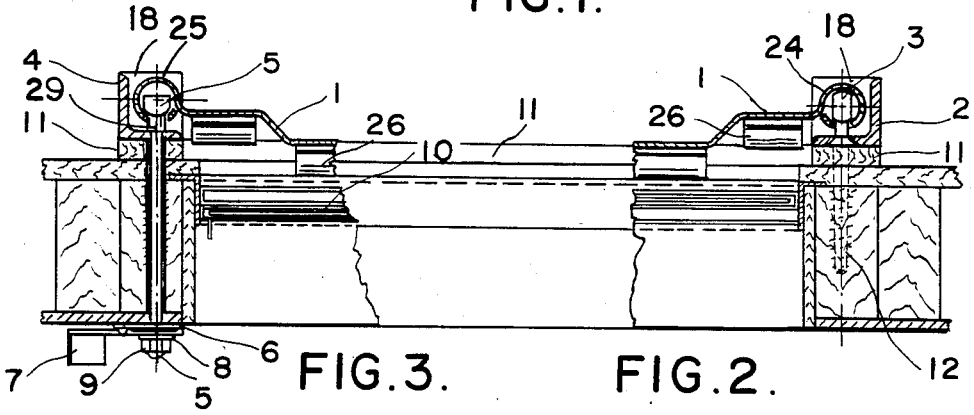
FIGS. 2 and 3 are fragmentary views as seen from the plane 2—2 in FIG. 1, showing the hinging side and the locking side, respectively, of the guard.

FIGS. 2 and 3 show that the guard element 1 also has a rolled or folded protecting edge 26 on both top and bottom horizontal edges for added security and rigidity. The guard element 1 is shown "indented" to minimize the separation between the guard element 1 and the window 10. The hinging cylindrical rim 24 and the locking cylindrical rim 25 are shielded by protecting frames 2 and 4, respectively. Both protecting frames 2 and 4 consist of an angle-iron (with protecting end covers 18) which is attached by screws or bolts 12 onto the window frame or wall studs 11 of the building. The hinge bolt 3 is welded or riveted onto the protecting frame 2. Protecting frame 4 provides an opening for the shaft of the locking bolt 5 to pass through both the protecting frame 4 and the window frame 11 or wall as shown. The locking bolt 5 has a shoulder 29 which is larger than this opening in the protecting frame 4, which limits the movement of the locking bolt 5 into the building. The hinge bolt 3 has a cylindrical neck and a head with a larger dimension extending outward in both directions colinearly along a vertical orientation. In FIG. 2, the head of the hinge bolt 3 extends orthogonally out of the plane of the drawing in both directions. The locking bolt 5 has a larger head on its shoulder with the width of the head equal to the diameter of the shoulder. In FIG. 3 the locking bolt 5 is shown with the larger dimension of the head extending within the drawing's plane.

Figure 4:
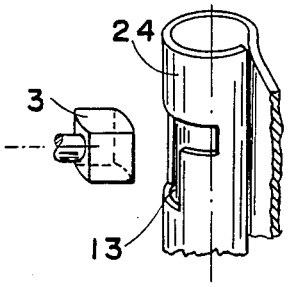
FIG. 4 is a fragmentary view of the hinge slit on the hinging-side cylindrical rim, and the head of the hinge bolt.
Figure 5:
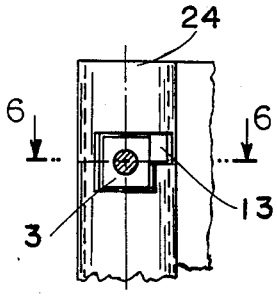
FIG. 5 is also a fragmentary view of the hinge slit, showing the hinge bolt positioned within such slit, with the guard in the open position, and also raised off the hinge bolt.

Referring to FIG. 4, the hinge bolt 3 is shown juxtaposed to a slit 13 in the cylindrical rim 24 forming an edge of the guard element 1. When the hinge bolt 3 is inserted into the slit 13, and the guard element 1 is lowered slightly, the horizontal upper edge of the slit 13 rides upon the narrow neck of the hinge bolt 3, and the entire head of the hinge bolt 3 is inside the tube formed by the cylindrical rim 24. Thus, the guard element 1 is retained in position on the hinge bolt 3 and may not be removed therefrom without lifting the guard element 1. The slit 13 consists of two sections: one section which has a smaller vertical dimension, and another, contiguous, section having a larger vertical dimension. The smaller section accommodates only the neck of the hinge bolt 3, while the larger section is large enough to admit the head of the hinge bolt 3. The guard element 1 can only be removed from the hinge bolt 3 when the guard element 1 is pivoted on the neck of the hinge bolt 3 to the "open" position (i.e., when the longitudinal axis of the hinge bolt 3 is directed toward the larger vertical section of the slit 13), and when the guard element 1 is lifted to allow the head of the hinge bolt 3 to pass through the slit 13, as shown in FIG. 5. When the guard element 1 is pivoted on the neck of the hinge bolt 3 so that the longitudinal axis of the hinge bolt 3 is directed toward the smaller vertical section of the slit 13, the head of the hinge bolt 3 (shown in dashed lines in FIG. 7) is too large to fit through such smaller portion, and the cylindrical rim 24 is not removable from the hinge bolt 3. Thus, the guard element 1 may only be removed or installed from the hinge bolt 3 when rotated to or positioned in the "open" position as described above, and when lifted or positioned to allow the hinge bolt 3 to pass through the larger vertical section of the slit 13.

Figure 7:
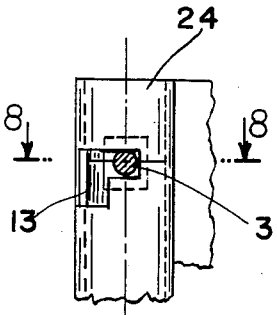
FIG. 7 is a fragmentary view of the hinge slit with the head of the hinge bolt positioned therein, with the guard in the closed position, and lowered to rest upon the hinge bolt's head.
Figure 6:
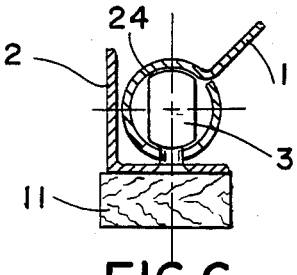
FIG. 6 is a fragmentary sectional view as seen from the plane 6—6 in FIG. 5, and including the protecting frame.
Figure 8:
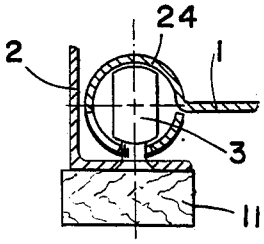
FIG. 8 is a fragmentary sectional view as seen from the plane 8—8 in FIG. 7, and including the protecting frame.

FIGS. 6 and 8 show sectional views of FIGS. 5 and 7, respectively, and examples of the guard element 1 in the open, removable position; and the closed, non-removable position, respectively.

The length of the upper horizontal edge of the slit 13 will determine how wide the guard element 1 is allowed to open. The positioning of the larger vertical section of the slit 13 will determine in what position the guard element 1 can be removed from the hinge bolt 3. During the entire swinging range of the guard element 1, the head of the hinge bolt 3 is inaccessible from the exterior due to the protection of the cylindrical rim 24 and the protecting frame 2. The neck and remainder of the hinge bolt 3 are similarly protected by the protecting frame 2, the protecting end cover 18, and the rolled or folded horizontal edge 26.

Figure 12:
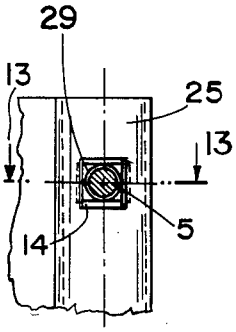
FIG. 12 is a fragmentary view of the locking bolt's head in the locking slit, with the locking bolt in the locked position.
Figure 10:
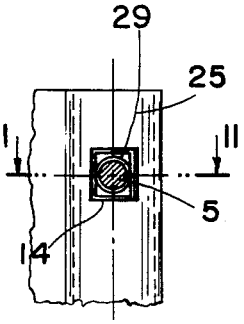
FIG. 10 is also a fragmentary view of the locking bolt positioned in the locking slit, with the locking bolt in the unlocked position.
Figure 9:
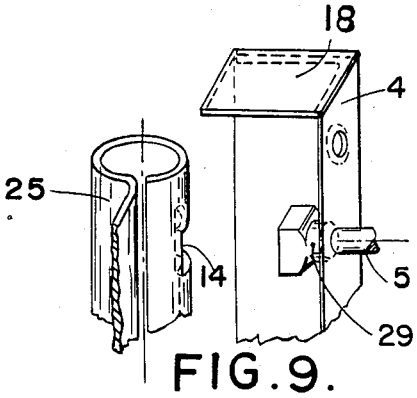
FIG. 9 is a fragmentary view of the locking slit on the locking-side cylindrical rim, and the head of the locking bolt, also showing the protecting frame and the protecting extension thereon.
Figure 13:
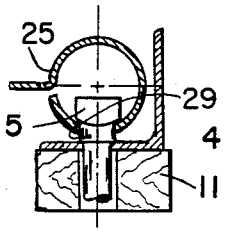
FIG. 13 is a fragmentary sectional view as seen from the plane 13—13 in FIG. 12.
Figure 11:
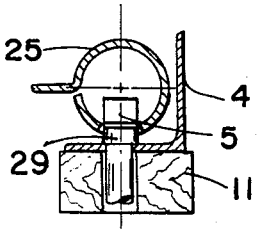
FIG. 11 is a fragmentary sectional view as seen from the plane 11—11 in FIG. 10, and including the protecting frame.

In FIG. 9, the locking bolt 5 is shown passing through a hole in the protecting frame 4, and being allowed to rotate about its own longitudinal axis. The head of the locking bolt 5 is able to pass through a slit 14 in the rear side (i.e., towards the building when the guard element 1 is in the closed position) of the cylindrical rim 25 of the guard element 1. This slit 14 is rectangular, having larger dimensions in the vertical than in the horizontal orientation. As shown in FIGS. 10 and 11, the head of the locking bolt 5 fits through the slit 14 and thus allows the guard element 1 to be attached to the locking bolt 5, only when the larger dimension of the head of the locking bolt 5 is aligned in a vertical orientation. When the locking bolt 5 is rotated 90° about its own longitudinal axis (as shown in FIGS. 12 and 13), the larger dimensions of the head of the locking bolt 5, now in a horizontal orientation, will not fit through the smaller dimension of the rectangular slit 14, and thus the locking bolt 5 may be securely locked into the cylindrical rim 25 of the guard element 1.

Figure 18:
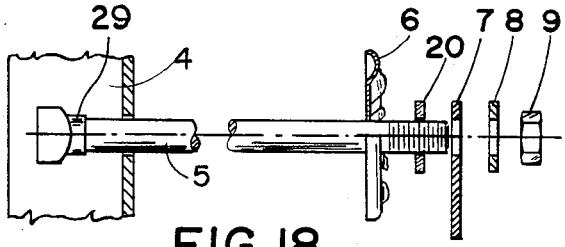
FIG. 18 is an exploded fragmentary view of the locking bolt and attachments which mount it to the inside of the wall.
Figure 19:
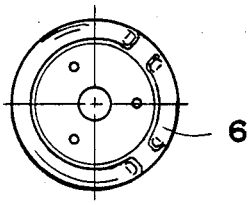
FIG. 19 is a front view of the guide rose.
Figure 21:
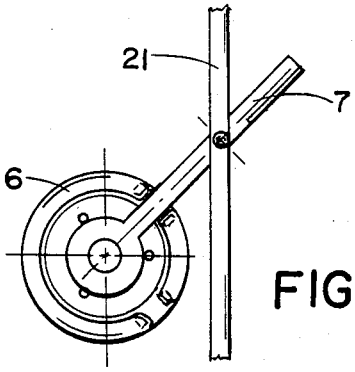
Figure 20:
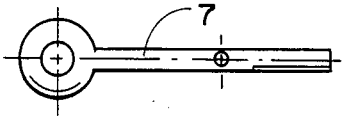
FIG. 20 is a front view of the lever.
Figure 23:
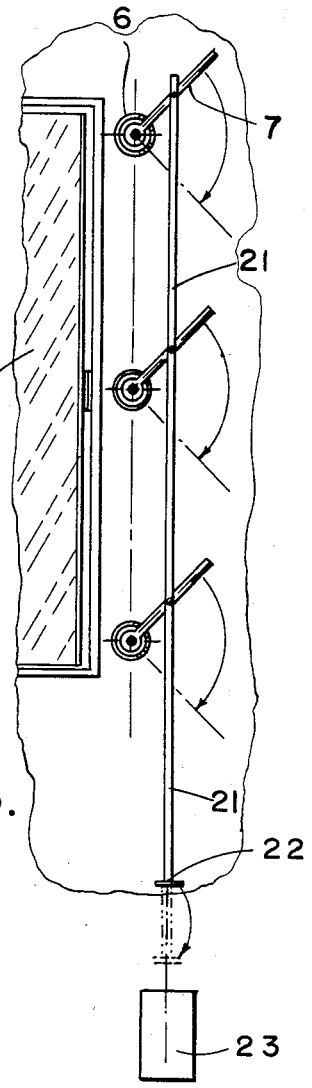
FIG. 23 is a fragmentary view seen from the inside of the wall, with three levers turning three locking bolts, connected by a connecting rod and activated by a handle or foot pedal.

Referring to FIGS. 3 and 18, the locking bolt 5 is shown passing through the window frame or wall 11 of the building. The larger shoulder 29 of the locking bolt 5 is too large to pass through the hole in the protecting frame 4, and thus holds the locking bolt 5 from the exterior. Further, a rose 6, rubber washer 20, lever 7, washer 8, and nut 9 hold the locking bolt 5 from the interior. The fit is loose enough to allow the locking bolt 5 to rotate, and this rotation is limited to 90° by the two pair of bosses on the rose 6 [FIG. 19]. The upper position of the lever 7 (shown in FIG. 21) is the locked position (with the locking bolt 5 as shown in FIGS. 12 and 13) and the lower position is the unlocked position (with the locking bolt 5 as shown in FIGS. 10 and 11). Such positioning aids in unlocking the guard element 1 under an emergency situation by someone in a weakened condition or a child, in that such person's weight could be used to pull down the lever 7 and unlock the guard element 1. Unlocking the guard element 1 may be achieved in a variety of ways. Multiple levers 7 connected to multiple locking bolts 5 may be joined together so that even when more than one locking bolt 5 is used, a single opening motion can unlock the guard element 1. Such an arrangement is shown in FIG. 23, where a connecting rod 21 links each respective lever 7. Opening may be achieved by a handle 22, or by a foot-actuated pedal 23, as shown.

Figure 16:
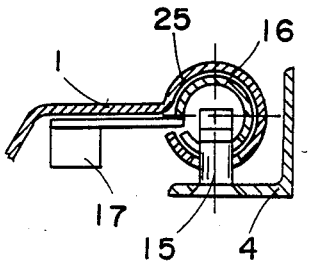
FIG. 16 is a fragmentary sectional view as seen from the plane 16—16 in FIG. 14.
Figure 14:
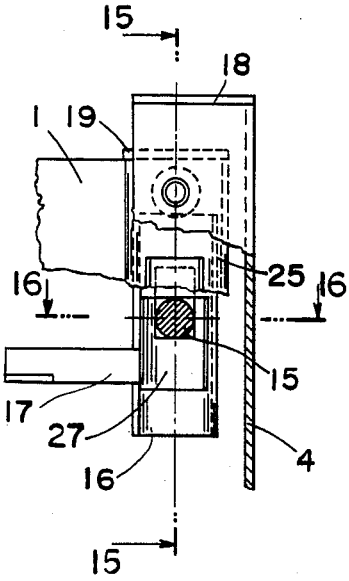
FIG. 14 is a fragmentary view from the interior of the guard showing an alternate latching method, with the latching bolt inside the slit in the cylindrical rim and the slot in the retainer, with the retainer in the locked position.
Figure 15:
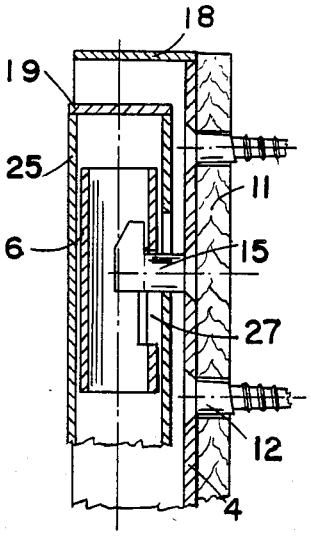
FIG. 15 is a fragmentary sectional view as seen from the plane 15—15 in FIG. 14, with the retainer in the locked position.
Figure 17:
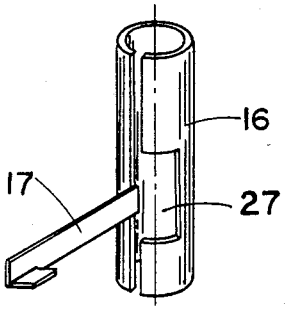
FIG. 17 is a view of the retainer and attached lifting arm.

Alternate means exist for locking and unlocking the guard element 1, where it is either difficult or undesirable to have the locking bolt 5 pass through the wall of the building, or to have the lever 7 mechanism mounted on the interior wall of the building. Referring to FIG. 16, the protecting frame 4 has a latching bolt 15 firmly welded thereto, consisting of a neck and a head which extends upward only in the vertical direction (i.e., a hook bolt) as seen more distinctly in FIG. 15. A retainer 16 is positioned inside the cylindrical rim 25 of the guard element 1 and (referring to FIG. 17) consists of a cylindrical tube which is attached to a lifting arm 17. A slot 27 is made in the retainer 16 through which the hook portion of the latching bolt 15 is allowed to pass as shown in FIGS. 14, 15, and 16. When the retainer 16 is raised in the vertical direction, either mechanically or manually, the latching bolt 15 is able to be inserted through the slot 27 in the retainer 16. When the retainer 16 is lowered, either mechanically or by gravity, the upper horizontal edge of the slot 27 rides upon the neck of the latching bolt 15, and the hook of the latching bolt 15 is not allowed to be removed from the retainer 16 or the cylindrical rim 25, and thus the guard element 1 is firmly locked. The retainer 16 can be long enough, and with a sufficient number of slots 27 to accommodate the use of multiple latching bolts 15, if desired. As additional security, the top and bottom of the protecting frame 4 are further protected by a protecting end cover 18 [FIGS. 1, 9, and 15]and the tops and bottoms of the cylindrical rims 24 and 25 are covered by protecting end covers 19 (as shown partially in FIGS. 14 and 15).

This alternate latching method may be used to protect either a window or a door. In the latter case, a key mechanism may easily be added to the guard such that turning a key would lift the lifting arm 17 to unlock the guard element 1. A door could thus be unlocked and opened from the outside by a key, and from the inside either by a key or manually.

Figure 22:
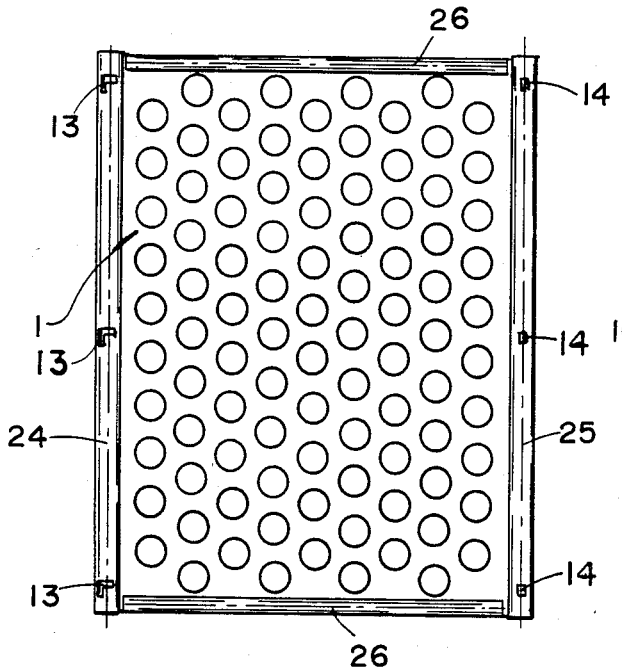
FIG. 22 is a rear view of a guard element.

FIG. 22 shows a view of the interior side of a guard element 1 having a different decorative pattern. This guard element 1 has hinge slits 13 in the hinging cylindrical rim 24; rectangular slits 14 in the locking cylindrical rim 25; and rolled or folded protecting edges 26 on the top and bottom of the guard element 1.

Figure 24:
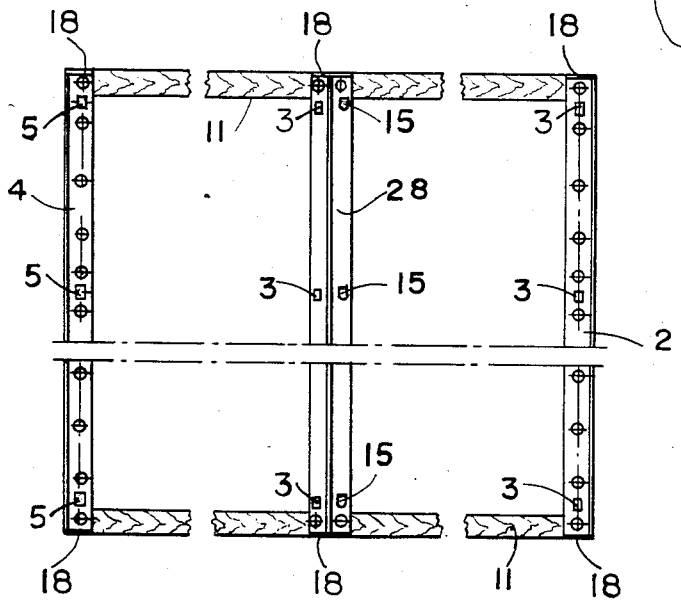
FIG. 24 is a front view of an alternate mounting procedure, to use two guard elements, and using both the standard and the alternate locking methods.

FIG. 24 shows a view from the exterior of the building of the window frame 11 and the hardware required for attachment of the guard element 1. This view shows an alternate mounting method using two guard elements 1, and both the "standard" and "alternate" latching methods. An additional frame member 28 is secured to the exterior of the wall in the center of the window opening, and consists of a T-bar; one side of which contains hinge bolts 3, and the other side of which is equipped with latching bolts 15. Two separate guard elements are used: the one on the left side (as seen in this drawing) being fixed to the wall by the hinge bolts 3 and the locking bolts 5 (which is unlocked by rotating the locking bolts 5 from inside the building); and the one on the right side (as seen in this drawing) being fastened by the hinge bolts 3 and the latching bolts 15 (which is unlocked by lifting the retainer 16 from the interior of the guard element 1).

Some of the obvious variations on the embodiment here disclosed includes positioning the hinging side and the locking side of the window guard on the horizontal edges of the guard element 1 to provide for an equivalent of a Bahama shutter. When the hinging side is placed on the bottom horizontal side of the window guard, and is suitably mounted to the exterior wall, unlocking the window guard would automatically open the window guard by gravity means alone.

The window guard may be unlocked by electromechanical means, such as by a solenoid, as well as manually. This allows unlocking by a switch located on a bedstand, or by a remote switch in an adult's room to open a window guard for a room occupied by a child or an elderly or infirm person. Similarly, a window guard could be unlocked automatically by the triggering of a fire detector or smoke detector. This approach would not only allow the egress of a person from inside the building in a time of fire, but would also allow rescue from outside of one who was unconscious inside. Many other variations and applications will be obvious to one skilled in the art to which this invention pertains.

Some of the many advantages of this type of window guard is that it embodies a simple mechanical system, which should be less costly than complicated security windows, and highly conducive to mass production. There is a minimum of service required on this window guard, since there are no springs or flexible cables to lubricate, or to be susceptible to deteriorating wear. When the window guard is installed, the screws or bolts by which the entire system is attached to the exterior of the building are completely hidden, and the hinging and locking mechanisms are similarly hidden and protected by solid masses of resistive material. Other security window guards which achieve a measure of protection against unauthorized unlocking remain vulnerable to assault by the use of snips or a hacksaw. The design of the present invention does not require any close tolerances on any of the parts involved. Further, the entire window guard can be taken off the building without any tools at all by simply unlocking the guard, swinging the guard away from the window, and lifting the guard off the hinges. This guard has obvious applications for residential, commercial, and industrial requirements.

I claim:

1. A guard for an opening in a wall or the like comprising: a generally planar guard element;

pivotal mounting means along one edge of said guard element for mounting said guard element upon said wall to cover the exterior of said opening when said guard element is in a substantially coplanar orientation to said wall;

said pivotal mounting means allowing said guard element to be pivotally moved away from said wall and out of a substantially coplanar orientation to said wall;

said pivotal mounting means allowing said guard element to be repetitively removed from attachment to said wall and to be repetitively remounted upon said wall, both without a tool or a key;

said pivotal mounting means being inaccessible and blocked from sight from the exterior of said guard element;

fastening means for securing said guard element to said wall, preventing either the removal or opening of said guard element and access to the interior of said opening;

said fastening means comprising:

a tubular member carried on the opposite edge of said guard element;

at least one slot in said tubular member;

at least one locking bolt carried on said wall to extend through said slot;

a head on said locking bolt;

said bolt being rotatable about its own axis between a locking position wherein said head may not be disengaged from said slot, and an opening position wherein said head will pass radially through said slot; and opening means for unlocking and allowing the pivotal opening of said guard element to allow egress from the interior of said opening;

said opening means not being capable of activation from the exterior of said guard element, said opening means comprising:

operating means accessible from the interior of said guard member and wall for rotating said lock bolt through about 90° between said locking and opening positions;

said unlocking and opening not requiring a tool or key or exceptional strength.

2. A guard as defined in claim 1 wherein said pivotal mounting means comprises:

a plurality of hinge bolts attached firmly to said wall, and a plurality of arcuate slits extending partially around a first cylindrical rim formed on said one edge of said guard element, aligned such that said hinge bolts may be positioned through said slits and thus inside and first cylindrical rim.

3. A guard as defined in claim 1 wherein: there are a plurality of locking bolts and corresponding slots; and said operating means comprises:

a plurality of levers for rotating said locking bolts.

4. A guard as defined in claim 3 wherein said levers are controlled by a single actuation by control means.

5. A guard as defined in claim 4 wherein said control means comprises a handle or the like attached to a rod connecting each of said levers.

6. A guard as defined in claim 1 wherein:

said opening means is actuated by electromechanical means.

7. A guard as defined in claim 6 wherein said electromechanical actuation is by non-human catalyst means, including a smoke detector and fire detector.

8. A guard for an opening in a wall or the like comprising:

a generally planar guard element;

pivotal mounting means along one edge of said guard element for mounting said guard element upon said wall to cover the exterior of said opening when said guard element is in a substantially coplanar orientation to said wall;

said pivotal mounting means allowing said guard element to be pivotally moved away from said wall and out of a substantially coplanar orientation to said wall;

said pivotal mounting means allowing said guard element to be repetitively removed from attachment to said wall and to be repetitively remounted upon said wall, both without a tool or a key;

said pivotal mounting means being inaccessible and blocked from sight from the exterior of said guard element;

fastening means for securing said guard element to said wall, preventing either the removal or opening of said guard element and access to the interior of said opening; and said fastening means comprising:

hooking means firmly attached to the exterior of said wall; and retaining means related to said guard element for retaining said hooking means by said guard element;

opening means for unlocking and allowing the pivotal opening of said guard element to allow egress from the interior of said opening;

said opening means not capable of activation from the exterior of said guard element;

neither said fastening means nor said opening means passing through said wall;

said unlocking and opening not requiring a tool or key or exceptional strength;

wherein said hooking means comprises:

a plurality of hook bolts firmly attached to the exterior of said wall; and wherein said retaining means comprises:

a second cylindrical rim on the opposite edge of said guard element and containing a plurality of slits aligned such that said hook bolts may pass through said slits when said guard element is in a substantially coplanar orientation to said wall; and a retainer comprised of a cylindrical tube, placed concentrically within said second cylindrical rim, movable along said tube's longitudinal axis, and having a plurality of slots therein, such that said hook bolts when inserted through said slits in said second cylindrical rim may also pass through said slots; and wherein:

securing means position said retainer such that in a first position said hook bolts may be removed from the interiors of said retainer and said second cylindrical rim and said guard element pivoted as described, and in a second position said hook bolts are retained by said retainer such that said guard element may not be pivoted or removed as described.

9. A guard as defined in claim 8 wherein said securing means comprises an arm attached to said retainer such that said first position is achieved by lifting said arm to lift said retainer; and that said second position is achieved by lowering, by gravity or otherwise, said arm to lower said retainer.

10. A locking device for a guard for an opening in a wall or the like, where said guard includes a guard element mounted upon the exterior of said wall in a substantially coplanar orientation to said wall and covering said opening, comprising:

hinge means for pivotal mounting of said guard element;

said hinge means having hinge bolt means, with first attachment means to attach said hinge bolt means to the exterior of said wall, and first receiving means for receiving said hinge bolt means;

which said first receiving means is attached to said guard element and which prevents access to and sight of both said hinge bolt means and said first attachment means from the exterior of said guard element; and wherein said first receiving means receives said hinge bolt means so as to allow said guard element attached to said first receiving means to pivot upon said hinge means, and so to move out of a substantially coplanar orientation to said wall; and locking means having locking bolt means with second attachment means to attach said locking bolt means to the exterior of said wall, and having second receiving means for receiving said locking bolt means;

which said second receiving means is attached to said guard element and which prevents access to and sight of both said locking bolt means and said second attachment means from the exterior of said guard element;

wherein said second receiving means receives said locking bolt means so as to allow said guard element attached to said second receiving means to be locked into a substantially coplanar orientation to said wall, so as to prevent access to said opening in said wall from the exterior of said guard element; and wherein said locking means prevents unlocking of said guard element from the exterior of said guard element; and wherein said guard element may be repetitively removed from said wall and repetitively remounted thereto without a tool or key.

11. A locking device as defined in claim 10 wherein said first receiving means comprises a rolled edge of said guard element forming a first cylindrical rim, and equipped with a plurality of slits therein which are adjacent to said hinge bolt means, comprising a plurality of hinge bolts firmly attached to a flanged member such that each respective hinge bolt is admitted through each respective slit so that the head of each hinge bolt is positioned inside said first cylindrical rim, thus positioning said guard element upon said hinge means; and further wherein said flanged member is equipped with a plurality of flanges extending orthogonally away from the plane of said wall, thereby protecting said first attachment means from access from the exterior of said wall so long as said guard element is thus positioned upon said hinge means.

12. A locking device as defined in claim 10 wherein said second receiving means comprises a rolled edge of said guard element forming a second cylindrical rim, and equipped with a plurality of slits therein which are adjacent to said locking bolt means;

comprising a plurality of locking bolts such that each respective locking bolt is admitted through each respective slit so that the head of each locking bolt is positioned inside said second cylindrical rim, thus enabling said guard element to be locked onto said locking means; and further wherein said locking bolts pass through a flanged member equipped with a plurality of flanges extending orthogonally away from the plane of said wall, thereby protecting said second attachment means from access from the exterior of said wall;

when said second cylindrical rim encompasses said heads of said locking bolts; and further where operating means rotates said locking bolts about the longitudinal axes of said locking bolts from the interior of said wall, both to lock said locking bolts into said second cylindrical rim and to unlock said locking bolts from said second cylindrical rim.

13. A locking device as defined in claim 12 wherein said operating means comprises a plurality of levers for rotating said locking bolts to lock and unlock said guard element.

14. A locking device as defined in claim 13 wherein said levers are controlled by a single actuation by control means.

15. A locking device as defined in claim 14 wherein said control means comprises a handle or the like attached to a rod connecting each of said levers.

16. A locking device as defined in claim 12 wherein said operating means is actuated by electromechanical means.

17. A locking device as defined in claim 16 wherein said electromechanical actuation is by non-human catalyst means, including a smoke detector or fire detector.

18. A locking device as defined in claim 10 wherein said locking means comprises hooking means firmly attached to the exterior of said wall, and retaining means related to said guard element for retaining said hooking means by said guard element, wherein said locking means does not pass through said wall.

19. A locking device as defined in claim 18 wherein:

said hooking means comprises a plurality of hook bolts firmly attached to the exterior of said wall; and wherein said retaining comprises:

a second cylindrical rim attached to one edge of said guard element and containing a plurality of slits thereon, aligned such that said hook bolts may pass through said slits when said guard element is in a substantially coplanar orientation to said wall, and a retainer comprised of a cylindrical tube, placed concentrically within said second cylindrical rim, movable along said tube's longitudinal axis, and having a plurality of slots therein, such that said hook bolts, when inserted through said slits in said second cylindrical rim, may also pass through said slots, and wherein securing means position said retainer such that in a first position said hook bolts may be removed from the interior of said retainer and said second cylindrical rim, and said guard pivoted as described, and in a second position said hook bolts are retained by said retainer such that said guard element may not be pivoted or removed as described.

20. A locking device as defined in claim 19 wherein said securing means comprises an arm attached to said retainer, such that said first position is achieved by lifting said arm to lift said retainer; and that said second position is achieved by lowering, by gravity or otherwise, said arm to lower said retainer.

21. A locking device as defined in claim 10 wherein said locking means allows unlocking of said guard element by the use of a key, but which otherwise prevents unlocking of said guard element from the exterior of said guard element.

* * * * *